US012492714B2

(12) United States Patent
Lischetzki

(10) Patent No.: US 12,492,714 B2
(45) Date of Patent: Dec. 9, 2025

(54) LOWERING CEILING FAN DEVICE

(71) Applicant: Gabriele Lischetzki, Waikoloa, HI (US)

(72) Inventor: Gabriele Lischetzki, Waikoloa, HI (US)

( * ) Notice: Subject to any disclaimer, the term of this patent is extended or adjusted under 35 U.S.C. 154(b) by 0 days.

(21) Appl. No.: 18/655,692

(22) Filed: May 6, 2024

(65) Prior Publication Data

US 2025/0163936 A1 May 22, 2025

Related U.S. Application Data

(60) Provisional application No. 63/601,243, filed on Nov. 21, 2023.

(51) Int. Cl.
*F04D 29/60* (2006.01)
*F04D 25/08* (2006.01)

(52) U.S. Cl.
CPC ..... *F04D 29/601* (2013.01); *F04D 25/088* (2013.01)

(58) Field of Classification Search
CPC ..... F21V 21/38; F21V 21/15; F21V 21/03; F21V 33/0096; F21V 21/16; F21V 21/36; F21V 23/04; F21V 21/008; F21V 23/045; F21V 27/00; F04D 25/088; F04D 29/601; F04D 29/646; F04D 27/00; B66D 1/36; B66D 1/56
See application file for complete search history.

(56) References Cited

U.S. PATENT DOCUMENTS

| | | | | |
|---|---|---|---|---|
| 1,856,017 | A | 4/1932 | Baker | |
| 2,079,942 | A | 5/1937 | LeVelle | |
| 4,073,598 | A | 2/1978 | Mizutani | |
| 5,154,579 | A | 10/1992 | Rezek | |
| 5,519,597 | A * | 5/1996 | Tsai | F21V 21/38 362/403 |
| 6,213,617 | B1 * | 4/2001 | Barker | F04D 25/088 362/802 |
| 6,443,702 | B1 | 9/2002 | Ross | |
| 6,585,487 | B2 * | 7/2003 | Nodd | F04D 25/088 416/146 R |
| 8,348,215 | B1 * | 1/2013 | Smith | F04D 25/088 242/390.8 |
| 11,840,432 | B2 * | 12/2023 | Dietz | F21V 21/03 |
| 2008/0037264 | A1 * | 2/2008 | Bennett | F21V 21/38 362/418 |
| 2008/0193291 | A1 * | 8/2008 | Ware | F04D 29/601 416/5 |
| 2009/0208333 | A1 * | 8/2009 | Smith | F04D 27/008 416/61 |
| 2010/0227499 | A1 * | 9/2010 | Ramos | H02G 3/20 439/537 |
| 2021/0180607 | A1 * | 6/2021 | Noble | F04D 29/053 |

* cited by examiner

*Primary Examiner* — Eric J Zamora Alvarez
(74) *Attorney, Agent, or Firm* — Brennan, Manna & Diamond, LLC

(57) ABSTRACT

A raising and lowering device is disclosed that is a height-adjustable mechanism that can be installed on ceiling fans, lights, and other elevated devices. The raising and lowering device comprises a hydraulic or mechanical mechanism that is used to lower ceiling fans and other objects for cleaning or maintenance. Users can operate the mechanism with a wireless remote control or manually. They hydraulic or mechanical mechanism lowers the fan and offers easy access for cleaning or maintenance. Users can then raise the device back up to the ceiling for use, once cleaned.

15 Claims, 3 Drawing Sheets

LOWERING CEILING FAN DEVICE

CROSS-REFERENCE TO RELATED APPLICATION

The present application claims priority to, and the benefit of, U.S. Provisional Application No. 63/601,243, which was filed on Nov. 21, 2023, and is incorporated herein by reference in its entirety.

FIELD OF THE INVENTION

The present invention relates generally to the field of raising and lowering devices. More specifically, the present invention relates to a specialized raising and lowering mechanism that can help make items like a ceiling fan more accessible for cleaning and maintenance. Accordingly, the present disclosure makes specific reference thereto. Nonetheless, it is to be appreciated that aspects of the present invention are also equally applicable to other like applications, devices and methods of manufacture.

BACKGROUND

By way of background, this invention relates to improvements in raising and lowering devices. Generally, elevated items like a ceiling fan can be difficult to clean, especially in rooms with significant distance between the floor and ceiling. Accordingly, people may need to use ladders, lifts, and other dangerous equipment to reach these areas. Further, injuries may occur if people fall from an elevated distance. Additionally, hiring people to clean and maintain these areas can be expensive, as well.

Ceiling fans are commonly placed in residences and business establishments to facilitate air movement within rooms. As is known, a ceiling fan motor comprises a stator, a rotor, and blades connected to the rotor to be rotated by the motor. Often, in electrical motors, the rotor is inside the stator. However, many ceiling fans employ an inside-out motor in which the rotor is on the outside and surrounds the stator. As to the ceiling fan structure, a motor is used for driving the vanes to rotate and produce winds, so as to achieve the air cooling effect.

Since the use of the ceiling fans is very popular in everyday life and users have high demands on stability, safety, comfortability, convenience for its functions, therefore finding a way for raising and lowering ceiling fan in order to clean the ceiling fan is needed.

Accordingly, there is a demand for an improved raising and lowering device that allows a ceiling fan to be easily cleaned and maintained. More particularly, there is a demand for a raising and lowering device that allows users to easily raise and lower the device via remote control or manually.

Therefore, there exists a long felt need in the art for a raising and lowering device that provides users with a specialized raising and lowering mechanism that can help make items like a ceiling fan more accessible for cleaning and maintenance. There is also a long felt need in the art for a raising and lowering device that features a hydraulic mechanism to raise and lower the ceiling fan. Further, there is a long felt need in the art for a raising and lowering device that features a mechanical mechanism like a rod and cord extension that works in conjunction to raise and lower the ceiling fan. Moreover, there is a long felt need in the art for a device that allows users to easily raise and lower the device via remote control or manual application. Further, there is a long felt need in the art for a raising and lowering device that functions with ceiling fans and other objects that are commonly found at elevated areas. Finally, there is a long felt need in the art for a raising and lowering device that eliminates the need to use ladders and lifts to reach these areas, improving safety for cleaning and maintenance.

The subject matter disclosed and claimed herein, in one embodiment thereof, comprises a raising and lowering device. The device is a height-adjustable mechanism that can be installed on ceiling fans, lights, and other elevated devices. The raising and lowering device comprises a hydraulic or mechanical mechanism that is used to lower ceiling fans and other objects for cleaning or maintenance. Users can operate the mechanism with a wireless remote control or manually. They hydraulic or mechanical mechanism lowers the fan and offers easy access for cleaning or maintenance. Users can then raise the device back up to the ceiling for use, once cleaned.

In this manner, the raising and lowering device of the present invention accomplishes all of the forgoing objectives and provides users with a device that raises and lowers ceiling fans for cleaning and maintenance. The device is hydraulic or mechanical. The device can be controlled manually or with a remote control.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a raising and lowering device. The device is a height-adjustable mechanism that can be installed on ceiling fans, lights, and other elevated devices. The raising and lowering device comprises a hydraulic or mechanical mechanism that is used to lower ceiling fans and other objects for cleaning or maintenance. Users can operate the mechanism with a wireless remote control or manually. They hydraulic or mechanical mechanism lowers the fan and offers easy access for cleaning or maintenance. Users can then raise the device back up to the ceiling for use, once cleaned.

In one embodiment, the raising and lowering device generally comprises a mechanism housed within a base component that is attachable to a ceiling and securely coupled to a ceiling fan, a light, or other elevated object, allowing for easy, safe, and ladder-free cleaning.

In one embodiment, the base component houses a motor and a controller which communicates with the motor. Typically, the controller is electrically coupled to the motor. The controller communicates with and selectively actuates the motor in the first or second direction, to raise or lower the ceiling fan or other elevated object.

In one embodiment, the motor typically comprises an electric motor. The motor is retained within the base component and secured to an outer surface of the ceiling. Also, the motor and the base component may be coupled to ceiling studs. The motor is preferably hard wired to the electrical circuitry of the dwelling. In another embodiment, the base component can comprise a rechargeable battery or other suitable independent power source for the motor.

In another embodiment, the motor is a hydraulic motor that functions to raise and lower the ceiling fan or other object by actuating a cable reel or other suitable means for winding up a cable which raises and lowers a ceiling fan or other object.

In one embodiment, the base component comprises a shaft, which has a first end attached to the motor, such that the motor may selectively rotate the shaft in a first direction or a second direction. The shaft has a second end which is attached to the cable reel, such that the shaft engages the cable reel to rotate it in a first direction or a second direction. Thus, the motor functions to rotate the shaft in a first direction and a second direction (i.e., effectively moving the fan or light fixture upwardly toward the ceiling and downwardly toward the ground surface).

In one embodiment, the base component comprises a cable reel or other suitable mechanism, such as a spindle or winch, with a length of cable wound around it. Typically, a cable, such as steel wire cable is wrapped around the cable reel. Cables and cable reels are well known to one of ordinary skill in the art. The first end of the cable is secured to the cable reel. The second end of the cable extends downwardly out of the bottom of the base component. The second end of the cable is attached to the fan or light fixture. The cable functions to raise and lower the fan or light fixture (i.e., via the motor, cable reel, etc.). Thus, rotating the cable reel raises or lowers the ceiling fan or other elevated object.

In one embodiment, disposed in the base component (i.e., in the inner cavity at the bottom of the base component below the cable reel) is a swivel pulley. The swivel pulley engages the cable. In some embodiments, the swivel pulley functions to allow an even winding and unwinding of the cable and to direct the cable through the bottom of the base component, for example through a cable aperture disposed in the bottom of the base component. A first micro switch may be disposed in the base component, for example on the swivel pulley. When the cable stop engages/touches the first micro switch, the motor is signaled to stop rotating the cable reel any further in that direction.

In some embodiments, a cable stop is disposed on the cable. The cable stop may be constructed in a variety of shapes (i.e., including but not limited to football-shaped) and from a variety of materials (i.e., including but not limited to metal, for example steel or other durable material). The placement of the cable stop can be adjusted. The cable stop can engage a first micro switch (i.e., disposed in the base component). When the cable stop engages the first micro switch, the micro switch stops the motor from rotating the cable reel in that direction any further. For example, a user can determine how much length of the cable is needed to lower the fixture to the floor and can set the cable stop, at such length, to cause the motor to stop at that length. In another embodiment, the cable stop can stop a user from trying to draw in the fan fixture too high.

In one embodiment, the base component comprises two limit switch components which are in communication with the motor. The two limit switch components are positioned to limit the movement of the cable and cable reel, by shutting off the motor when the cable has reached the limit for upwards or downwards movement.

In one embodiment, the cable reel is spring-loaded as a safety feature, which may help prevent accidental unwinding and a free fall drop of the ceiling fan or other object.

In one embodiment, the device further comprises a remote control for controlling the motor. For example, a transmitter is disposed in the remote control, which can communicate with a receiver operatively connected to the motor within the base component. When a first button is pressed on the remote control, the motor rotates the cable reel in the first direction to move the fan or light fixture down towards the ground surface. The motor stops when the first micro switch is activated by the cable stop. When a second button is pressed on the remote control, the motor rotates the cable reel in the second direction to move the fan or light back towards the ceiling. The motor stops when the second micro switch is activated. In some embodiments, the remote control is configured to control multiple fans or fixtures either independently of each other or together, and as such may comprise a plurality of buttons, which control different fans or fixtures.

In one embodiment, the device can be controlled manually. A user would be able to reach up and grasp the ceiling fan base and pull it down to lower it and then raise it up when cleaned. In another embodiment, the device can be hard-wired into a wall switch or a push button on the ceiling fan, such that the wall switch or push button controls the motor to raise or lower the ceiling fan manually.

In one embodiment, the device can be controlled via a smart device. The raising and lowering device includes a wireless communications module and additional sensors which would allow the device to pair with a mobile application on a smart device. Once paired, a user could control the raising and lowering device via the mobile application. Typically, the mobile device or smart device may be a cellular telephone, a remote control, or any other device that may have wireless communication capabilities and may be connected to the internet. The mobile or smart device may perform any type of wireless communication, including, but not limited to, WIFI, BLUETOOTH, RFID, NFC, etc. The device further includes a wireless communication module and additional sensors which would allow the device to pair with a mobile application on a mobile or smart device. Once paired, a user could control the raising and lowering device via the mobile application.

For purposes of this document, a connection may be a direct connection or an indirect connection (i.e., via intervening elements). Two devices are "in communication" if they are directly or indirectly connected so that they can communicate electronic signals between them.

In use, the motor rotates the shaft in a first direction so that cable is unwound from the cable reel, which, in turn, lowers the ceiling fan to a reachable level. The ceiling fan may then be cleaned. Once the cleaning is finished, the motor is used to rotate the shaft in a second direction so that the cable is wound around the cable reel, along with the ceiling fan, is lifted.

In yet another embodiment, the raising and lowering device comprises a plurality of indicia.

In yet another embodiment, a method of raising or lowering a ceiling fan is disclosed. The method includes the steps of providing a raising and lowering device comprising a hydraulic or mechanical mechanism for lowering and raising objects. The method also comprises inserting the hydraulic or mechanical mechanism onto a ceiling fan or other elevated object. Further, the method comprises lowering the ceiling fan for cleaning and maintenance via manual application or a remote control, as needed. Finally, the method comprises raising the ceiling fan via manual application or a remote control, for use.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
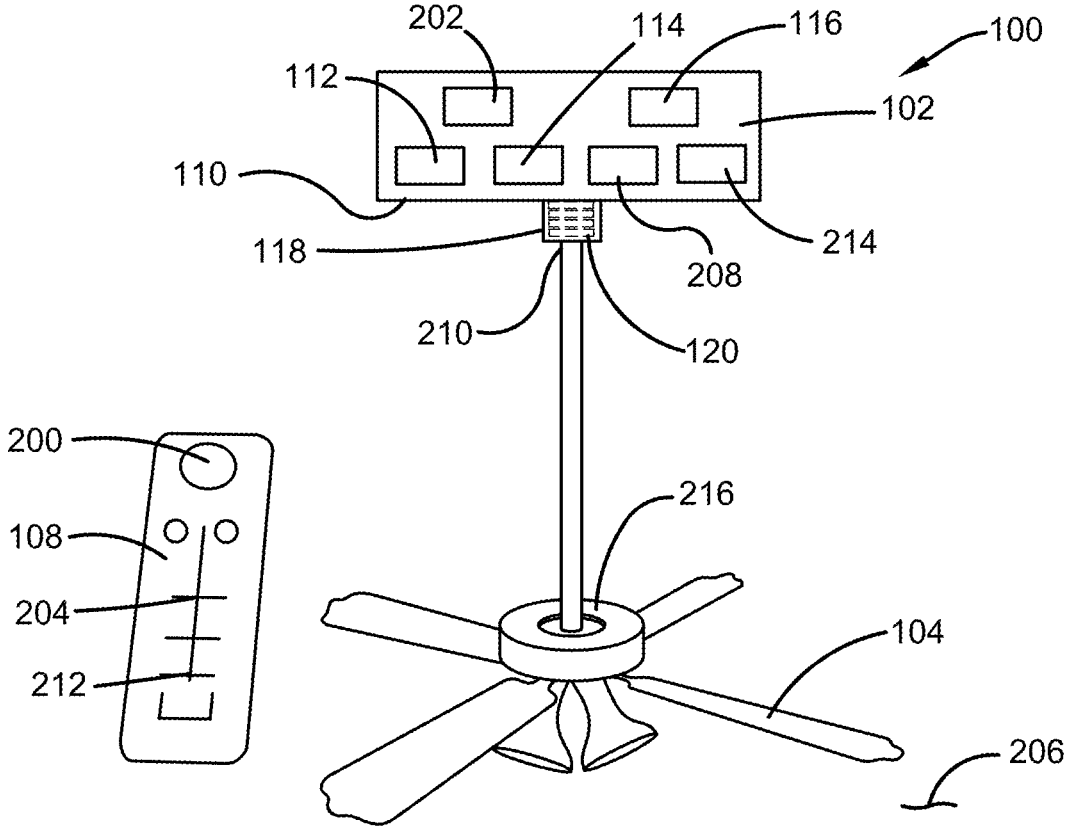
FIG. 1 illustrates a perspective view of one embodiment of the raising and lowering device of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a raising and lowering device that provides users with a specialized raising and lowering mechanism that can help make items like a ceiling fan more accessible for cleaning and maintenance. There is also a long felt need in the art for a raising and lowering device that features a hydraulic mechanism to raise and lower the ceiling fan. Further, there is a long felt need in the art for a raising and lowering device that features a mechanical mechanism like a rod and cord extension that works in conjunction to raise and lower the ceiling fan. Moreover, there is a long felt need in the art for a device that allows users to easily raise and lower the device via remote control or manual application. Further, there is a long felt need in the art for a raising and lowering device that functions with ceiling fans and other objects that are commonly found at elevated areas. Finally, there is a long felt need in the art for a raising and lowering device that eliminates the need to use ladders and lifts to reach these areas, improving safety for cleaning and maintenance.

The present invention, in one exemplary embodiment, is a novel raising and lowering device. The device is a height-adjustable mechanism that can be installed on ceiling fans, lights, and other elevated devices. The raising and lowering device comprises a hydraulic or mechanical mechanism that is used to lower ceiling fans and other objects for cleaning or maintenance. Users can operate the mechanism with a wireless remote control or manually. They hydraulic or mechanical mechanism lowers the fan and offers easy access for cleaning or maintenance. The present invention also includes a novel method of raising or lowering a ceiling fan. The method includes the steps of providing a raising and lowering device comprising a hydraulic or mechanical mechanism for lowering and raising objects. The method also comprises inserting the hydraulic or mechanical mechanism onto a ceiling fan or other elevated object. Further, the method comprises lowering the ceiling fan for cleaning and maintenance via manual application or a remote control, as needed. Finally, the method comprises raising the ceiling fan via manual application or a remote control, for use.

Referring initially to the drawings, FIG. 1 illustrates a perspective view of one embodiment of the raising and lowering device 100 of the present invention. In the present embodiment, the raising and lowering device 100 is an improved raising and lowering device 100 that provides a user 106 with a mechanism for raising and lowering ceiling fans 104 and other elevated objects. Specifically, the device 100 is a height-adjustable mechanism that can be installed on ceiling fans 104, lights, and other elevated objects. The raising and lowering device 100 comprises a hydraulic or mechanical mechanism that is used to lower ceiling fans 104 and other objects for cleaning or maintenance. Users 106 can operate the mechanism with a wireless remote control 108 or manually. Accordingly, the hydraulic or mechanical mechanism lowers the fan 104 and offers easy access for cleaning or maintenance. Users 106 can then raise the device 100 back up to the ceiling 110 for use, once cleaned.

Generally, the raising and lowering device 100 comprises a mechanism housed within a base component 102 that is attachable to a ceiling 110 and securely coupled to a ceiling fan 104, a light, or other elevated object, allowing for easy, safe, and ladder-free cleaning.

Furthermore, the base component 102 houses a motor 112 and a controller 114 which communicates with the motor 112. Typically, the controller 114 is electrically coupled to the motor 112. The controller 114 communicates with and selectively actuates the motor 112 in the first or second direction, to raise or lower the ceiling fan 104 or other elevated object.

For purposes of this document, a connection may be a direct connection or an indirect connection (i.e., via intervening elements). Two devices are "in communication" if they are directly or indirectly connected so that they can communicate electronic signals between them.

In one embodiment, the motor 112 typically comprises an electric motor. The motor 112 is retained within the base component 102 and secured to an outer surface of the ceiling 110. Also, the motor 112 and the base component 102 may be coupled to ceiling studs. The motor 112 is preferably hard wired to the electrical circuitry of the dwelling. In another embodiment, the base component 102 can comprise a rechargeable battery 116 or other suitable independent power source for the motor 112.

In another embodiment, the motor 112 is a hydraulic motor that functions to raise and lower the ceiling fan 104 or other object by actuating a cable reel 118 or other suitable means for winding up a cable 120 which raises and lowers a ceiling fan 104 or other object.

Figure 2:
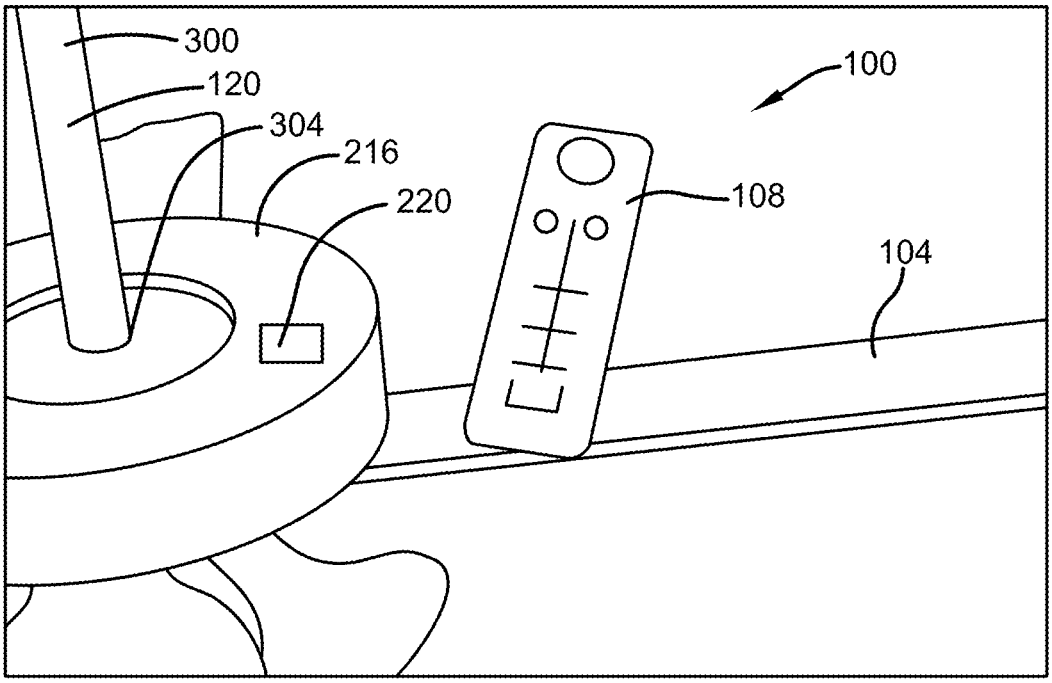
FIG. 2 illustrates a perspective view of one embodiment of the raising and lowering device of the present invention showing the remote control in accordance with the disclosed architecture.

As shown in FIG. 2, the device 100 further comprises a remote control 108 for controlling the motor 112. For example, a transmitter 200 is disposed in the remote control 108, which can communicate with a receiver 202 operatively connected to the motor 112 within the base component 102. When a first button 204 is pressed on the remote control 108, the motor 112 rotates the cable reel 118 in the first direction to move the fan 104 or light fixture down towards the ground surface 206. The motor 112 stops when the first micro switch 208 is activated by the cable stop 210. When a second button 212 is pressed on the remote control 108, the motor 112 rotates the cable reel 118 in the second direction to move the fan 104 or light back towards the ceiling 110. The motor 112 stops when the second micro switch 214 is activated. In some embodiments, the remote control 108 is configured to control multiple fans 104 or fixtures either independently of each other or together, and as such may comprise a plurality of buttons 204, 212, which control different fans 104 or fixtures.

Further, the device 100 can be controlled manually. A user 106 would be able to reach up and grasp the ceiling fan base 216 and pull it down to lower it and then raise it up when cleaned. In another embodiment, the device 100 can be hard-wired into a wall switch 218 or a push button 220 on the ceiling fan 104, such that the wall switch 218 or push button 220 controls the motor 112 to raise or lower the ceiling fan 104 manually.

Figure 3:
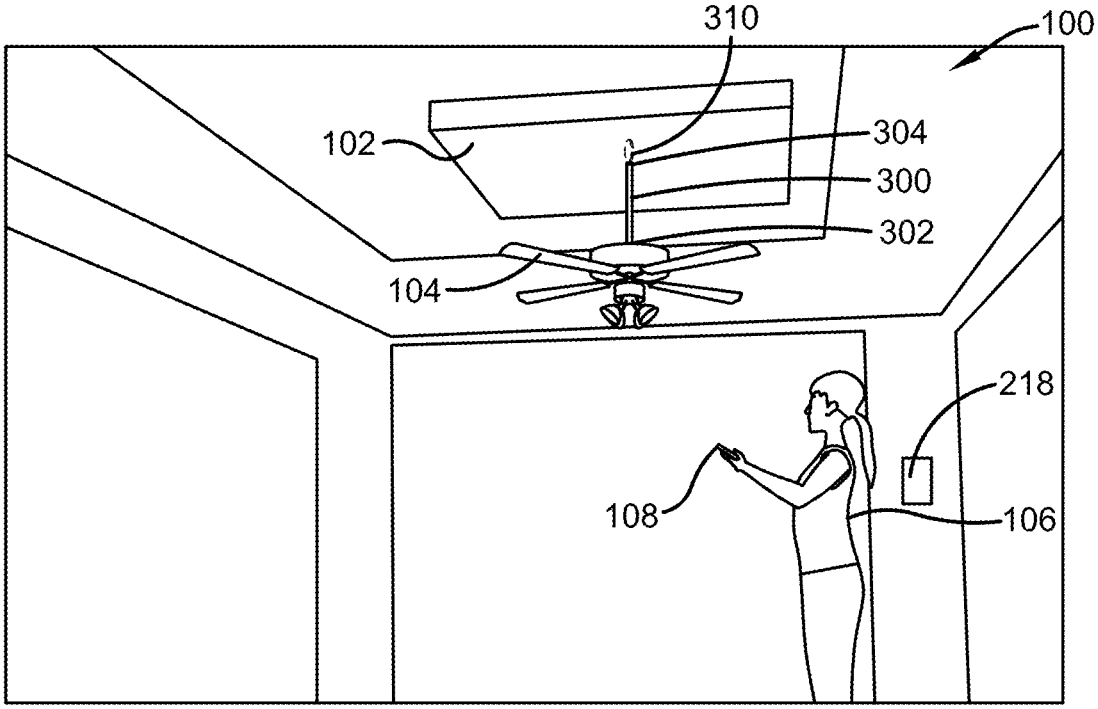
FIG. 3 illustrates a perspective view of one embodiment of the raising and lowering device of the present invention showing the ceiling fan raised in accordance with the disclosed architecture.
Figure 4:
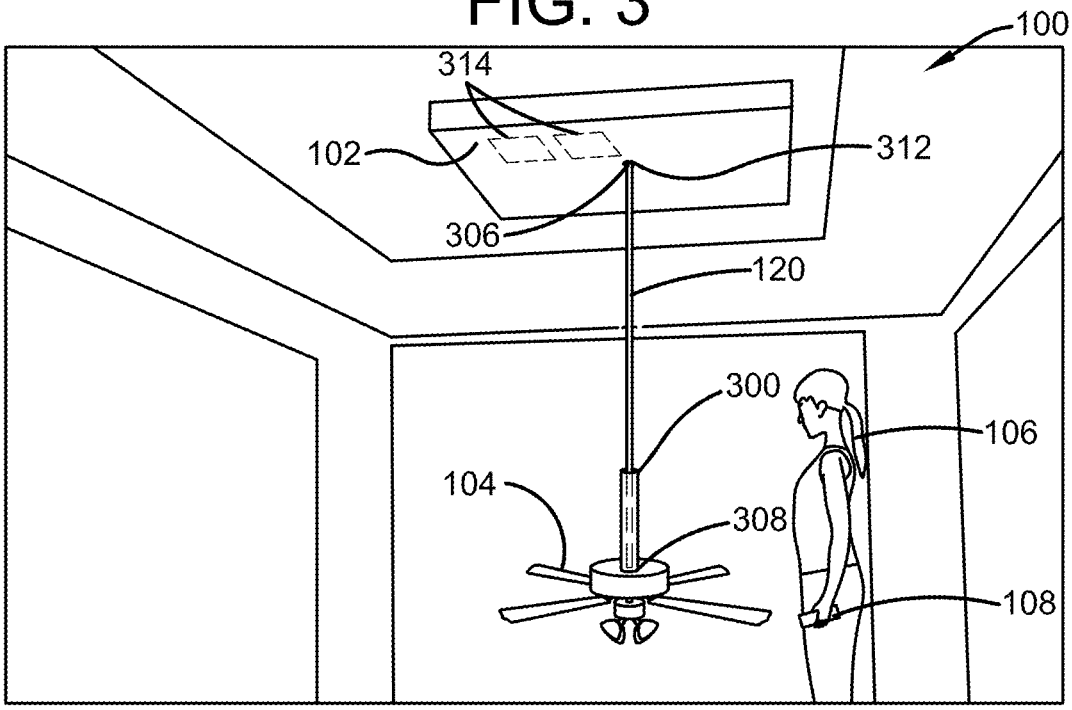
FIG. 4 illustrates a perspective view of one embodiment of the raising and lowering device of the present invention showing the ceiling fan being lowered in accordance with the disclosed architecture.

As shown in FIGS. 3-4, the base component 102 comprises a shaft 300, which has a first end 302 attached to the motor 112, such that the motor 112 may selectively rotate the shaft 300 in a first direction or a second direction. The shaft 300 has a second end 304 which is attached to the cable reel 118, such that the shaft 300 engages the cable reel 118 to rotate it in a first direction or a second direction. Thus, the motor 112 functions to rotate the shaft 300 in a first direction and a second direction (i.e., effectively moving the fan 104 or light fixture upwardly toward the ceiling 110 and downwardly toward the ground surface 206).

Further, the base component 102 comprises a cable reel 118 or other suitable mechanism, such as a spindle or winch, with a length of cable 120 wound around it. Typically, a cable 120, such as steel wire cable is wrapped around the cable reel 118. Cables 120 and cable reels 118 are well known to one of ordinary skill in the art. The first end 306 of the cable 120 is secured to the cable reel 118. The second end 308 of the cable 120 extends downwardly out of the bottom of the base component 102. The second end 308 of the cable 120 is attached to the fan 104 or light fixture. The cable 120 functions to raise and lower the fan 104 or light fixture (i.e., via the motor 112, cable reel 118, etc.). Thus, rotating the cable reel 118 raises or lowers the ceiling fan 104 or other elevated object.

In one embodiment, disposed in the base component 102 (i.e., in the inner cavity at the bottom of the base component 102 below the cable reel 118) is a swivel pulley 310. The swivel pulley 310 engages the cable 120. In some embodiments, the swivel pulley 310 functions to allow an even winding and unwinding of the cable 120 and to direct the cable 120 through the bottom of the base component 102, for example through a cable aperture 312 disposed in the bottom of the base component 102. A first micro switch 208 may be disposed in the base component 102, for example on the swivel pulley 310. When the cable stop 210 engages/touches the first micro switch 208, the motor 112 is signaled to stop rotating the cable reel 118 any further in that direction.

In another embodiment, a cable stop 210 is disposed on the cable 120. The cable stop 210 may be constructed in a variety of shapes (i.e., including but not limited to football-shaped) and from a variety of materials (i.e., including but not limited to metal, for example steel or other durable material). The placement of the cable stop 210 can be adjusted. The cable stop 210 can engage a first micro switch 208 (i.e., disposed in the base component 102). When the cable stop 210 engages the first micro switch 208, the micro switch 208 stops the motor 112 from rotating the cable reel 118 in that direction any further. For example, a user 106 can determine how much length of the cable 120 is needed to lower the fixture to the floor 206 and can set the cable stop 210, at such length, to cause the motor 112 to stop at that length. In another embodiment, the cable stop 210 can stop a user 106 from trying to draw in the fan fixture 104 too high.

In yet another embodiment, the base component 102 comprises two limit switch components 314 which are in communication with the motor 112. The two limit switch components 314 are positioned to limit the movement of the cable 120 and cable reel 118, by shutting off the motor 112 when the cable 120 has reached the limit for upwards or downwards movement.

In one embodiment, the cable reel 118 is spring-loaded as a safety feature, which may help prevent accidental unwinding and a free fall drop of the ceiling fan 104 or other object.

Figure 5:
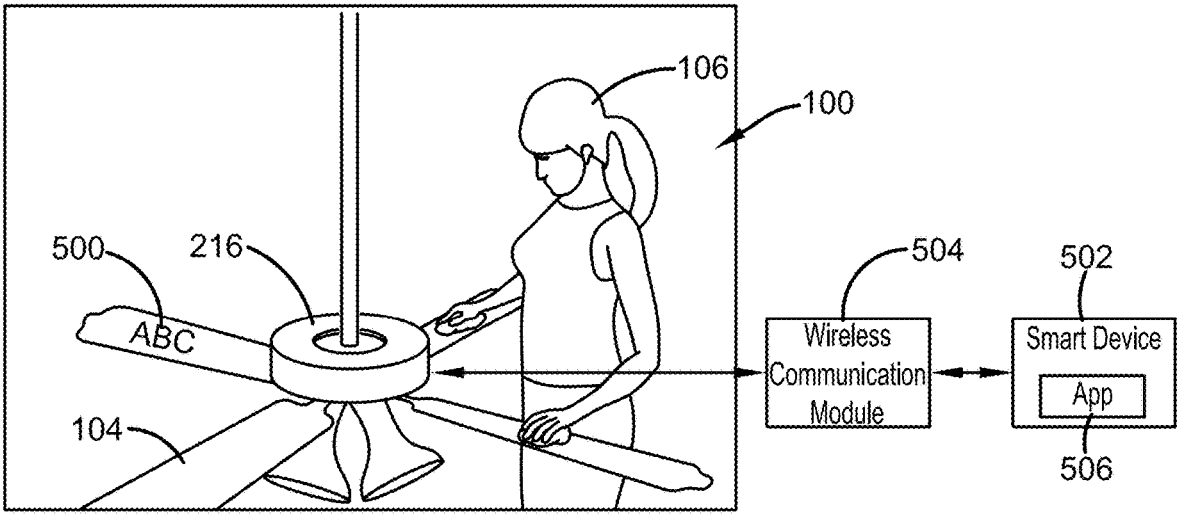
FIG. 5 illustrates a perspective view of one embodiment of the raising and lowering device of the present invention showing the ceiling fan being cleaned in accordance with the disclosed architecture.

As shown in FIG. 5, the device 100 can be controlled via a smart device 502. The raising and lowering device 100 includes a wireless communications module 504 and additional sensors which would allow the device 100 to pair with a mobile application 506 on a smart device 502. Once paired, a user 106 could control the raising and lowering device 100 via the mobile application 506. Typically, the mobile device or smart device 502 may be a cellular telephone, a remote control, or any other device that may have wireless communication capabilities and may be connected to the internet. The mobile or smart device 502 may perform any type of wireless communication, including, but not limited to, WIFI, BLUETOOTH, RFID, NFC, etc. The device 100 further includes a wireless communication module 504 and additional sensors which would allow the device 100 to pair with a mobile application 506 on a mobile or smart device 502. Once paired, a user 106 could control the raising and lowering device 100 via the mobile application 506.

In use, the motor 112 rotates the shaft 300 in a first direction so that cable 120 is unwound from the cable reel 118, which, in turn, lowers the ceiling fan 104 to a reachable level. The ceiling fan 104 may then be cleaned. Once the cleaning is finished, the motor 112 is used to rotate the shaft 300 in a second direction so that the cable 120 is wound around the cable reel 118, along with the ceiling fan 104, is lifted.

In yet another embodiment, the raising and lowering device 100 comprises a plurality of indicia 500. The base component 102 of the device 100 may include advertising, a trademark, or other letters, designs, or characters, printed, painted, stamped, or integrated into the base component 102, or any other indicia 500 as is known in the art. Specifically, any suitable indicia 500 as is known in the art can be included, such as but not limited to, patterns, logos, emblems, images, symbols, designs, letters, words, characters, animals, advertisements, brands, etc., that may or may not be ceiling fan, cleaning, or brand related.

Figure 6:
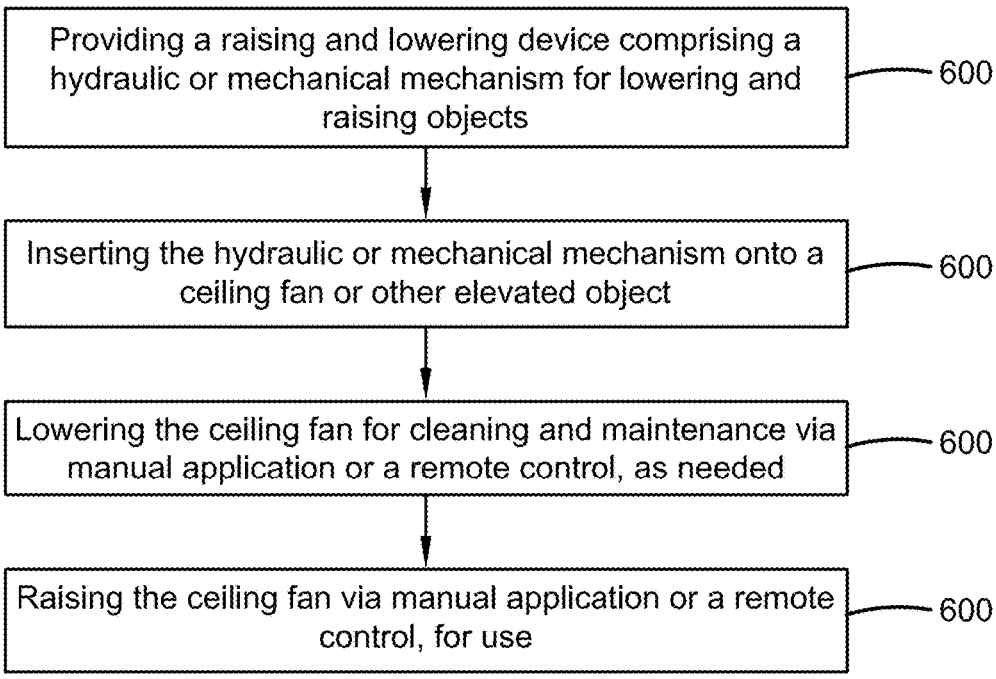
FIG. 6 illustrates a flowchart showing the method of raising or lowering a ceiling fan in accordance with the disclosed architecture.

FIG. 6 illustrates a flowchart of the method of raising or lowering a ceiling fan. The method includes the steps of at 600, providing a raising and lowering device comprising a hydraulic or mechanical mechanism for lowering and raising objects. The method also comprises at 602, inserting the hydraulic or mechanical mechanism onto a ceiling fan or other elevated object. Further, the method comprises at 604, lowering the ceiling fan for cleaning and maintenance via manual application or a remote control, as needed. Finally, the method comprises at 606, raising the ceiling fan via manual application or a remote control, for use.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "raising and lowering device", "raising device", "lowering device", and "device" are interchangeable and refer to the raising and lowering device 100 of the present invention.

Notwithstanding the forgoing, the raising and lowering device 100 of the present invention can be of any suitable size and configuration as is known in the art without affecting the overall concept of the invention, provided that it accomplishes the above stated objectives. One of ordinary skill in the art will appreciate that the raising and lowering device 100 as shown in FIGS. 1-6 is for illustrative purposes only, and that many other sizes and shapes of the raising and lowering device 100 are well within the scope of the present disclosure. Although the dimensions of the raising and lowering device 100 are important design parameters for user convenience, the raising and lowering device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A raising and lowering device that provides a user with a mechanism for raising and lowering ceiling fans or lights, the raising and lowering device comprising:

a base component;

a remote control;

wherein the base component houses a motor and a controller which communicates and selectively actuates the motor a shaft, which has a first end attached to the motor, a second end which is attached to a cable spindle such that the shaft engages the cable spindle to rotate it in a first direction or a second direction;

wherein a first end of the cable is secured to the cable spindle and a second end of the cable extends downwardly out of a bottom of the base component, with the second end of the cable being attached to a ceiling fan to raise and lower the ceiling fan;

wherein the remote control is configured to control the motor of the raising and lowering device;

wherein a swivel pulley is positioned within an inner cavity at a bottom of the base component below the cable spindle and is configured to direct the cable through an aperture in the bottom of the base component; and wherein the cable further comprises a football-shaped cable stop; and wherein the base component further comprises an indicia stamped onto an external surface of the base component.

2. The raising and lowering device of claim 1, wherein the motor is an electric motor retained within the base component and secured to an outer surface of a ceiling.

3. The raising and lowering device of claim 2, wherein the motor is hard wired to electrical circuitry of a dwelling.

4. The raising and lowering device of claim 2, wherein the motor is powered by a rechargeable battery.

5. The raising and lowering device of claim 1, wherein the motor is a hydraulic motor.

6. The raising and lowering device of claim 2, wherein the raising and lowering device can be hard-wired into a wall switch or a push button on the ceiling fan, such that the wall switch or push button controls the motor to raise or lower the ceiling fan manually.

7. The raising and lowering device of claim 1, wherein the football-shaped cable stop engages a first micro switch, which acts to stop the motor from rotating the cable spindle in either the first or second direction any further.

8. The raising and lowering device of claim 7, wherein the football-shaped cable stop is adjustable.

9. A method of raising or lowering a ceiling fan, the method comprising the following steps:

providing the raising and lowering device of claim 1;

lowering the ceiling fan for cleaning and maintenance via manual application or the remote control, as needed; and raising the ceiling fan via manual application or the remote control.

10. A raising and lowering device that provides a user with a mechanism for raising and lowering ceiling fans or lights, the raising and lowering device comprising:

a base component;

wherein the base component houses a motor and a controller which communicates and selectively actuates the motor;

wherein the motor is an electric motor retained within the base component and secured to an outer surface of a ceiling and hard wired to electrical circuitry of a dwelling;

a shaft, which has a first end attached to the motor, a second end which is attached to a cable spindle, such that the shaft engages the cable spindle to rotate it in a first direction or a second direction; and wherein a first end of the cable is secured to the cable spindle and a second end of the cable extends downwardly out of a bottom of the base component, with the second end of the cable being attached to a ceiling fan to raise and lower the ceiling fan;

wherein disposed within an inner cavity in the base component, below the cable spindle, is a swivel pulley that functions to allow an even winding and unwinding of the cable and to direct the cable through a bottom of the base component through a cable aperture;

wherein a football-shaped cable stop is disposed on the cable, which stops the motor from rotating the cable spindle in either the first or the second direction;

wherein a remote control is provided for controlling the motor, and a transmitter is disposed in the remote control, which can communicate with a receiver operatively connected to the motor within the base component; and wherein a wall switch or a push button on the ceiling fan is hard-wired to control the motor to raise or lower the ceiling fan manually; and wherein the base component further comprises an indicia integrated onto an external surface of the base component.

11. The raising and lowering device of claim 10, wherein the base component houses two limit switch components which are in communication with the motor, which shut off the motor when the cable has reached a limit for upwards or downwards movement.

12. The raising and lowering device of claim 10, wherein the cable spindle is spring-loaded as a safety feature, which helps prevent accidental unwinding and a free fall drop of the ceiling fan.

13. The raising and lowering device of claim 10, wherein the raising and lowering device is controlled via a smart device.

14. The raising and lowering device of claim 13, allowing the raising and lowering device to pair with a mobile application on the smart device, and once paired, a user is allowed to control the raising and lowering device via the mobile application.

15. The raising and lowering device of claim 10, wherein the motor is a hydraulic motor.

* * * * *